US005174310A

United States Patent [19]

Galbraith et al.

[11] Patent Number: 5,174,310

[45] Date of Patent: Dec. 29, 1992

[54] COSMETIC DISPENSER

[76] Inventors: Marie R. Galbraith, 133 E. 64th St., 10021; Judith H. Green, 555 Park Ave., both of New York, N.Y. 10021

[21] Appl. No.: 774,033

[22] Filed: Oct. 7, 1991

[51] Int. Cl.[5] ..... A45D 42/02

[52] U.S. Cl. ..... 132/316; 132/318; 401/52

[58] Field of Search ..... 132/318, 316; 401/52

[56] References Cited

U.S. PATENT DOCUMENTS

| | | | |
|---|---|---|---|
| D. 238,399 | 1/1976 | Swenson . | |
| 1,890,068 | 12/1932 | Schall | 132/316 |
| 2,039,323 | 5/1936 | Lessin . | |
| 2,121,221 | 6/1938 | Fontan | 132/316 |
| 2,456,948 | 12/1948 | Kaye | 132/316 |
| 2,458,020 | 1/1949 | Olsen . | |
| 2,512,476 | 6/1950 | Birnkrant et al. . | |
| 2,684,680 | 7/1954 | Jakab | 132/316 |
| 2,814,384 | 11/1957 | Dulberg | 132/318 X |

FOREIGN PATENT DOCUMENTS

| | | | |
|---|---|---|---|
| 106504 | 1/1939 | Australia | 132/316 |
| 648879 | 1/1951 | United Kingdom | 401/52 |

*Primary Examiner*—Steven A. Bratlie

*Attorney, Agent, or Firm*—Marshall & Melhorn

[57] ABSTRACT

A cosmetic dispenser which has a first tubular element, including a cosmetic holder for dispensing cosmetics, and a second associated tubular element, including a mirror for observing the application of the cosmetics. The first tubular element has a cylindrical space between an outer sleeve and an inner sleeve for telescopically receiving the second tubular element. The mirror is carried in a protective mounting on the second tubular element to reduce the possibility of damaging the mirror when sliding the second tubular element into or out of the first tubular element. When the two elements are combined for storage purposes, the surface of the mirror is protected by the outer sleeve of the first tubular element.

5 Claims, 2 Drawing Sheets

COSMETIC DISPENSER

BACKGROUND OF THE INVENTION

This invention pertains to a cosmetic dispenser, and more particularly, to an improved cosmetic dispenser with two separable elements, one containing a cosmetic applicator and the other a mirror.

The object of the present invention is to provide a new, improved cosmetic dispenser having a means for storing a mirror inside an outer sleeve of the cosmetic applicator when not in use. A person carrying a cosmetic dispenser often desires to apply cosmetics, such as lipstick, when no mirror is available to assist in the application of the cosmetics. The cosmetic dispenser of the present invention provides a cosmetic applicator in one element and a mirror in a second element. By combining these two elements into one convenient cosmetic dispenser, a person desiring to apply lipstick or other cosmetics does not need to carry a separate mirror or find a facility with a mirror.

In the prior art, there have been successful attempts to produce structures which combine a cosmetic dispenser with a mirror. U.S. Pat. No. 2,039,323 describes a mirror hinged to a corner of a lipstick holder having a spring means for pivotally moving the mirror with respect to a cover on the side of the lipstick holder. U.S. Pat. No. 2,121,221 discloses a structure including a mirror mounted on one side of a cover of a lipstick receptacle whereby the mirror is protected by a cover plate mounted on an end plate of the lipstick receptacle. The cover plate slides directly over the mirror when the lipstick receptacle is inserted into or withdrawn from the cover, placing the mirrored surface in jeopardy of being scratched or damaged when inserting or withdrawing the lipstick receptacle from the cover.

The combined cosmetic holder and mirror shown in U.S. Pat. No. 2,458,020 includes a mirror attached by a spring hinge to a cover of a cosmetic holder. The spring hinged mirror is difficult to hold and achieve the desired viewing angle when applying cosmetics. U.S. Pat. No. 2,512,476 discloses a lipstick holder having a mirror hingedly mounted on a cover in which the mirror is moved from a position of storage to a position of use by a separate operating mechanism.

SUMMARY OF THE INVENTION

In accordance with the present invention, there is provided a cosmetic dispenser having two separate elements. A first tubular element is used for holding and applying cosmetics, such as lipstick; and a second associated tubular element having a mirror is used to assist a person in applying the cosmetics. When assembled for storage, the second tubular element is typically inserted between an outer sleeve and an inner sleeve of the first tubular element to protect the mirror. The mirror is disposed in the second tubular element in a manner to provide additional protection to the mirror.

The second tubular element of the present invention is telescopically received in a space provided between the outer sleeve and the inner sleeve of the first tubular element. The second tubular element has a protective mounting, such as a recess, in which a mirror is carried. The protective mounting reduces the possibility of damaging the mirror when sliding the second tubular element into or out of the first tubular element. When not in use, the mirror is inside the outer sleeve of the first tubular element and is protected from dirt and scratches.

The first tubular element, when separated from the second tubular element, is open at one end to permit the cosmetics to be axially extended for application by the user. Means are provided for selectively moving the cosmetics from a position of storage to a position of use in the inner sleeve of the first tubular element.

BRIEF DESCRIPTION OF THE DRAWINGS

The above, as well as other advantages of the present invention, will become readily apparent to those skilled in the art in the following detailed description of a preferred embodiment when considered in the light of the accompanying drawings in which.

DESCRIPTION OF THE PREFERRED EMBODIMENT

Figure 1:
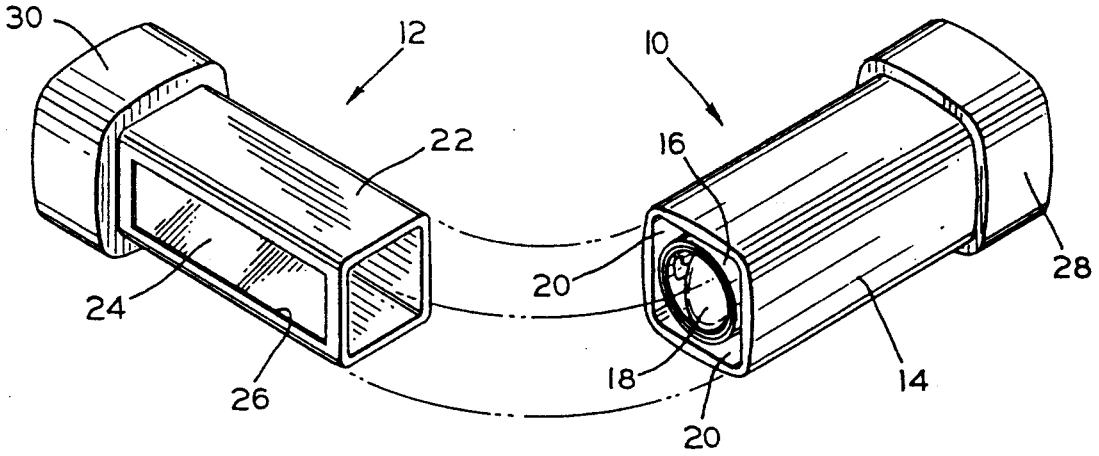
FIG. 1 is an exploded perspective view of the two tubular elements of the cosmetic dispenser in a separated position.

Referring now to the drawings, there is illustrated in FIG. 1 an exploded perspective view of a preferred embodiment of the invention including a first tubular element 10 and a second tubular element 12 in a separated position preparatory to use. The first element 10 includes an outer sleeve 14 and an inner sleeve 16 disposed in spaced relation within the outer sleeve 14. The inner sleeve 16 is designed to retain a cosmetic 18 such as lipstick, for example. The inner sleeve 16 is inwardly spaced from the outer sleeve 14 and the inner sleeve 16 extends the full length of the outer sleeve 14 to form a cylindrical space 20 to receive the second tubular element 12.

Figure 4:
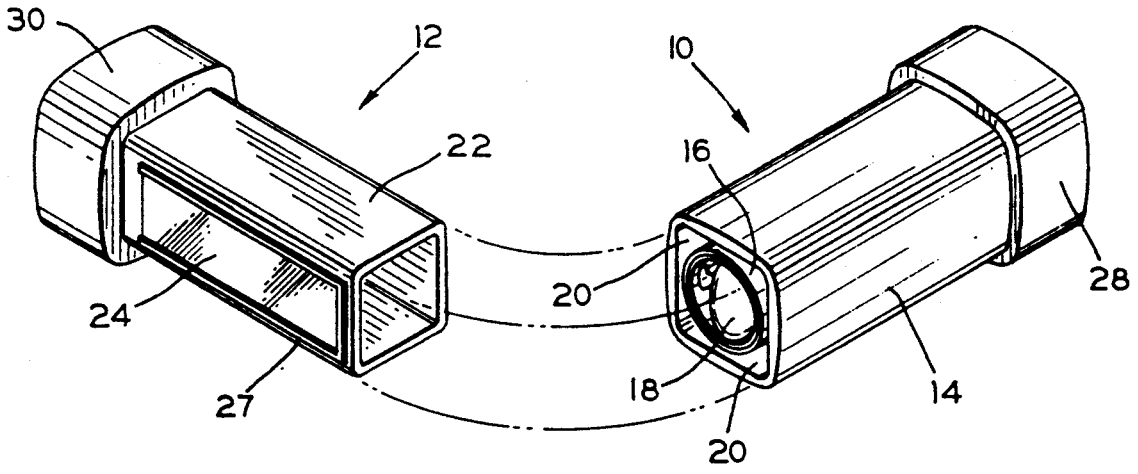
FIG. 4 is an exploded perspective view of the two tubular elements, similar to FIG. 1, showing slide rails.

The second tubular element 12 is comprised of a sleeve 22 on which a mirror 24 is mounted on the surface of the sleeve 22. It may be preferable to mount the mirror 24 in a recess 26 to provide additional protection to the surface thereof. When the second element 12 is telescopically inserted into the first element 10, the sleeve 22 is received in the cylindrical space 20 between the outer sleeve 14 and the inner sleeve 16. By recessing the mirror 24, there is less likelihood that the surface of the mirror 24 will be scratched or damaged when the second element 12 is inserted into or withdrawn from the cylindrical space 20 of the first element 10 The sleeve 22 is adapted to fit into the cylindrical space 20 in such a fashion that the mirror 24 is completely protected. Alternative means, such as slide rails 27 shown in FIG. 4, may be used instead of the recess 26 to maintain a spaced relationship between the mirror 24 and the outer sleeve 14.

The first element 10 is open at one end to permit the cosmetic 18 to be axially extended when in use and for receiving the second element 12 when in storage. A grasping portion 28 is mounted on the opposite end of the first element 10. The peripheral surface of the grasping portion 28 extends radially beyond the outer surface of the outer sleeve 14 to provide a convenient means of gripping the first element 10 to enable the second element 12 to be withdrawn therefrom.

A grasping portion 30 is also mounted on the end of the second element 12. The peripheral surface of the grasping portion 30 on the second element 12 extends radially beyond the outer surface of the sleeve 22. When in the storage position, the peripheral surface of the grasping portion 30 also extends radially beyond the outer sleeve 14 to provide a convenient means of gripping the second element 12.

When the second element 12 is received by the first element 10 in the storage position, the outer sleeve 14 encloses the mirror 24 and the sleeve 22 contains the cosmetic 18 in the inner sleeve 16. In the preferred embodiment, the edge of the outer sleeve 14 abuts the inner surface of grasping portion 30 in the storage position. The cosmetic 18 and the mirror 24 are enclosed and protected from dirt and other damaging materials.

Figure 2:
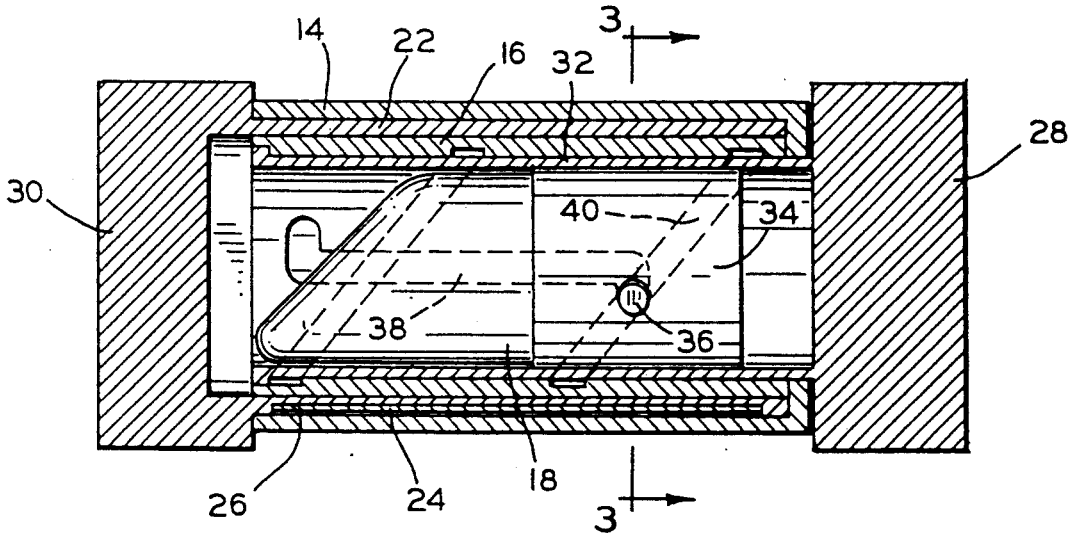
FIG. 2 is a longitudinal sectional view of the present invention after the two tubular elements shown in FIG. 1 have been assembled for storage and the assemblage has been rotated 90° from the FIG. 1 illustration to more clearly show the overall structure.
Figure 3:
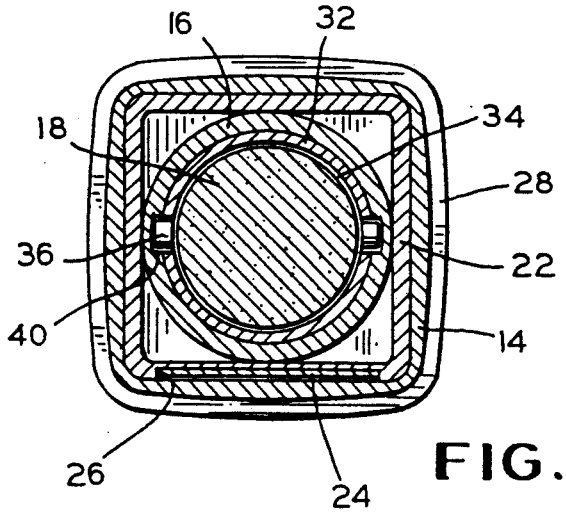
FIG. 3 is a sectional view taken along line 3—3 of FIG. 2.

Several different types of mechanical means can be used to axially extend the cosmetic 18 in the inner sleeve 16. In FIGS. 2 and 3, there is disclosed a helical style rotational system. The inner sleeve 16 has a full-length, rotatable liner 32 affixed to the grasping portion 28, which is also rotatable. The rotatable liner 32 has a cosmetic driver 34 with integral pins 36 adapted to extend through longitudinal slots 38 in the rotatable liner 32 and thence into helical grooves 40 on the inner surface of the inner sleeve 16. When the grasping portion 28 is manually rotated relative to the outer sleeve 14, the liner 32 is caused to rotate causing the cosmetic driver 34 to extend or retract the cosmetic 18, as the case may be, in the liner 32 of inner sleeve 16 The helical system is used in many cosmetic applicators and is ideally suited for extending and retracting the cosmetic 18 when the first element 10 is separated from the second element 12. Other mechanical systems may also be used to axially extend the cosmetic 18.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A cosmetic dispenser comprising:

(a) a first tubular element, including an outer sleeve with a generally square cross-sectional configuration, an inner sleeve with a round cross-sectional configuration disposed within the outer sleeve and inwardly spaced therefrom, a cosmetic within the inner sleeve, and means for rotatably extending and retracting the cosmetic relative to the outer sleeve;

(b) a second tubular element having a generally square cross-sectional configuration, including a mirrored surface, adapted to be telescopically received between the inner sleeve and the outer sleeve of said first tubular element for protective storage of the mirrored surface; and (c) means for providing a spaced relationship between the mirrored surface of said second tubular element and a facing inner surface of the outer sleeve of said first tubular element, whereby the mirrored surface is protected at times of relative movement between said first tubular element and said second tubular element.

2. The cosmetic dispenser according to claim 1 wherein said means for providing a spaced relationship includes a recess in a surface of said second tubular element for receiving the mirrored surface.

3. A cosmetic dispenser comprising:

(a) a first tubular element, including an outer sleeve having a generally square cross-sectional configuration, an inner sleeve with a round cross-sectional configuration disposed within the outer sleeve and inwardly space therefrom, a cosmetic within the inner sleeve, and means for rotatably extending and retracting the cosmetic relative to the outer sleeve;

(b) a second tubular element having a generally square cross-sectional configuration, including a recessed planar surface, adapted to be telescopically received between the inner sleeve and the outer sleeve of said first tubular element; and (c) a mirror disposed within the recessed planar surface of said second tubular element whereby said mirror is protected by the recess at times of relative movement between said first tubular element and said second tubular element.

4. The cosmetic dispenser according to claim 1 wherein said means for providing a spaced relationship includes a slide rail means attached to said second tubular element.

5. The cosmetic dispenser according to claim 1 wherein said means for providing a spaced relationship includes a slide rail means attached to the inner surface of the outer sleeve.

* * * * *